US009513081B2

(12) United States Patent
Nguyen

(10) Patent No.: US 9,513,081 B2
(45) Date of Patent: Dec. 6, 2016

(54) PAINTBALL EJECTING APPARATUSES AND METHODS THEREFOR

(71) Applicant: Dong Thanh Nguyen, Rowlett, TX (US)

(72) Inventor: Dong Thanh Nguyen, Rowlett, TX (US)

( * ) Notice: Subject to any disclaimer, the term of this patent is extended or adjusted under 35 U.S.C. 154(b) by 0 days.

(21) Appl. No.: 13/689,670

(22) Filed: Nov. 29, 2012

(65) Prior Publication Data

US 2013/0167821 A1 Jul. 4, 2013

Related U.S. Application Data

(63) Continuation-in-part of application No. 12/962,400, filed on Dec. 7, 2010, now Pat. No. 8,381,710.

(51) Int. Cl.

| | |
|---|---|
| ***F41B 11/02*** | (2006.01) |
| ***F41B 11/53*** | (2013.01) |
| ***F41B 11/50*** | (2013.01) |

(52) U.S. Cl.

CPC ..... *F41B 11/53* (2013.01); *F41B 11/50* (2013.01)

(58) Field of Classification Search

USPC ..... 124/73, 45, 48, 49, 51.1, 53.5

See application file for complete search history.

(56) References Cited

U.S. PATENT DOCUMENTS

| | | | | |
|---|---|---|---|---|
| 5,520,171 | A * | 5/1996 | David | 124/51.1 |
| 6,415,781 | B1 * | 7/2002 | Perrone | 124/51.1 |
| 6,418,919 | B1 * | 7/2002 | Perrone | 124/49 |
| 6,467,473 | B1 | 10/2002 | Kostiopoulos | |
| 6,488,019 | B2 | 12/2002 | Kotsiopoulos | |
| 6,609,511 | B2 | 8/2003 | Kotsiopoulos et al. | |
| 7,441,556 | B2 | 10/2008 | Friesen et al. | |
| 7,966,999 | B2 | 6/2011 | Bosch et al. | |
| 8,381,710 | B2 * | 2/2013 | Nguyen | 124/51.1 |
| 2003/0005917 | A1 | 1/2003 | Kim | |
| 2005/0274371 | A1 * | 12/2005 | Lubben | 124/51.1 |
| 2006/0081233 | A1 * | 4/2006 | Andresen | 124/51.1 |
| 2006/0157041 | A1 | 7/2006 | Friesen | |
| 2007/0012304 | A1 * | 1/2007 | van Dorsser et al. | 124/51.1 |
| 2007/0256676 | A1 * | 11/2007 | Orvis et al. | 124/31 |
| 2008/0236558 | A1 * | 10/2008 | Bosch et al. | 124/48 |
| 2010/0000505 | A1 * | 1/2010 | Yeh | 124/51.1 |
| 2011/0220086 | A1 | 9/2011 | Bosch et al. | |

OTHER PUBLICATIONS

"Non Final Office Action", U.S. Appl. No. 12/962,400, Mailing Date: Dec. 23, 2011.

"Final Office Action", U.S. Appl. No. 12/962,400, Mailing Date: Jun. 18, 2012.

* cited by examiner

*Primary Examiner* — Bret Hayes

(74) *Attorney, Agent, or Firm* — IPSG, P.C. Intellectual Property Law

(57) ABSTRACT

A paintball ejecting apparatus includes a current control mechanism to control current flow to a motor, the current control mechanism including a switch activator having at least a first state and a second state. The switch activator in the first state is physically forced by a paintball to occupy a first position to cause the switch to not permit a current to flow to the motor when the switch activator is in the first state. The switch activator in the second state is not physically forced by any paintball, thereby occupying a second position that results in the switch permitting current to flow to the motor when the switch activator is in the second state.

18 Claims, 12 Drawing Sheets

PAINTBALL EJECTING APPARATUSES AND METHODS THEREFOR

PRIORITY CLAIM

This continuation-in-part application claims priority under 37 CFR 1.53(b) of and claims the benefit under 35 U.S.C. §120 to a commonly assigned. patent application entitled "PAINTBALL EJECTING APPARATUSES AND METHODS THEREFOR", application Ser. No. 12/962,400 filed on Dec. 7, 2000 which issued as U.S. Pat. No. 8,381,710 B2 on Feb. 26, 2013.

BACKGROUND OF THE INVENTION

Paintball is a bobby and a sport that has been popular for a number of years. A paintball game may involve multiple users, each of whom is equipped with a paintball gun. The paintball gun is generally designed to eject or shoot paintballs onto a target when the operator aims the paintball gun at the target and squeezes the trigger. Scores are then kept for the number of hits, the location of hits, the number of times a player is shot at, etc. In addition to its recreational role, paintball guns may also be used to mark trees, cattle, and the like.

FIG. 1 shows a simplified schematic of a prior art paintball gun 102, including a barrel 104 and a body 106. A hopper 108 is disposed atop of body 106 and is designed to hold a number of paintballs. The operator typically pre-loads a hopper 108 through a lid 110. Gravity-fed or force-fed paintballs then enter the breech. When the operator pulls trigger 112, a predetermined volume of compressed gas from a compressed gas bottle 114 pushes the paintball out of the breech and along barrel 104 on its way to the target.

While the prior art paintball gun of FIG. 1 serves its purpose, there are disadvantages. For example, the presence of a large hopper of paintballs atop gun body 106 presents a larger target area for other players to shoot at. Under certain competition rules, a paintball striking any part of an opponent's paintball gun, including hopper 108, represents a hit. Accordingly, a player may suffer a larger number of "hits" if his paintball gun presents a larger target area. Further, the position of hopper 108 relative to gun body 106 introduces center of gravity concerns. This is particularly true when hopper 108 is filled with paintballs. Since hopper 108 is disposed on top of body 106, the high center of gravity makes the paintball gun less stable, leading to fatigue and inaccurate shooting. As another example, the forward position of hopper 108 relative to the gun handle means that the paintball gun of FIG. 1 tends to be nose-heavy, requiring the operator to compensate using his wrist. Over time, this forward position too leads to earlier fatigue and/or inaccurate shooting.

In view of the foregoing, there are desired improved apparatuses and methods for shooting paintballs.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

Figure 1:
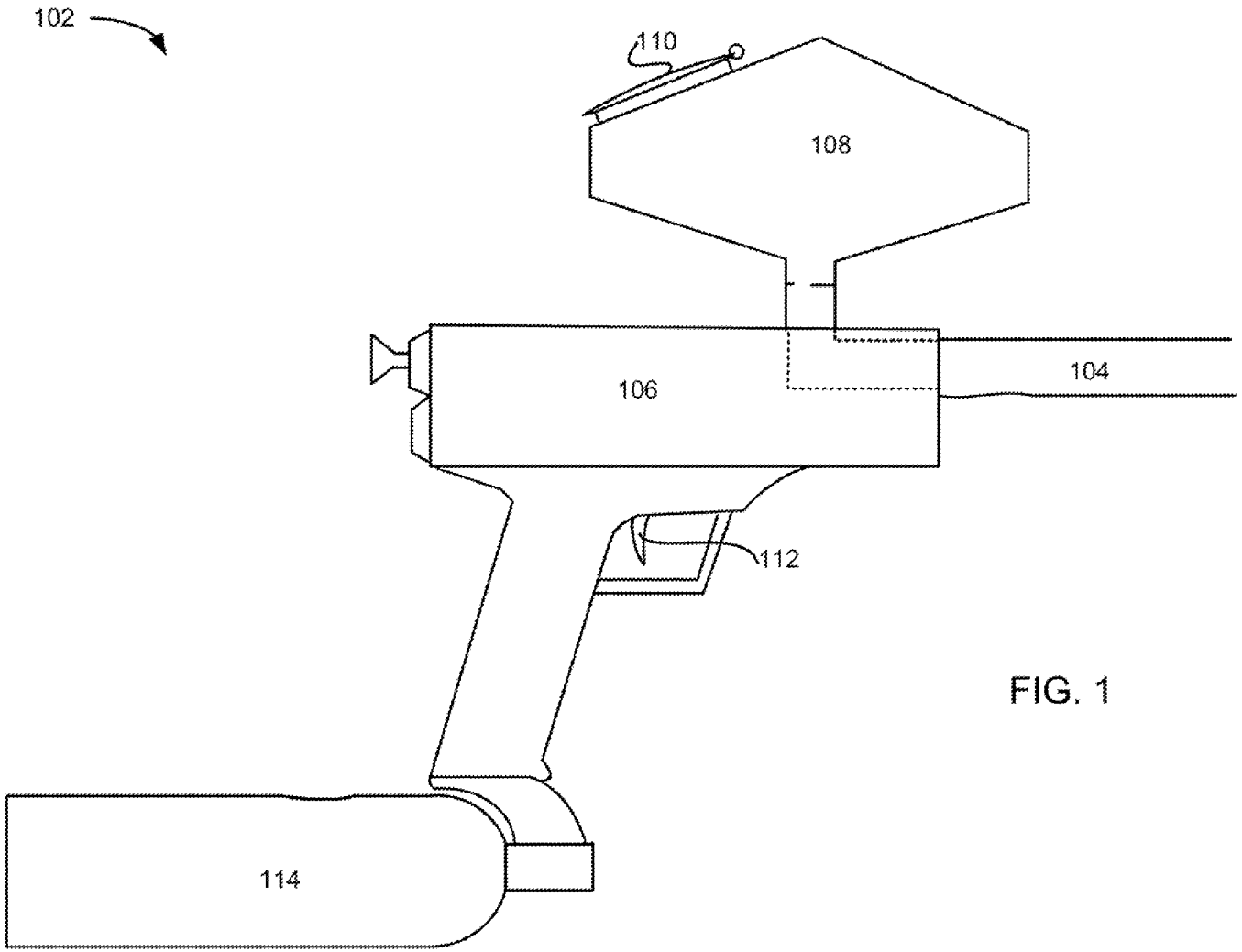
FIG. 1 shows a simplified schematic of a prior art paintball gun.

The present invention will now be described in detail with reference to a few embodiments thereof as illustrated, in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Embodiments of the invention relate to a paintball ejecting apparatus, such as a paintball gun, for ejecting paintballs from a breech through and out of a barrel. In one or more embodiments, a paintball reservoir is mounted away from the top of the gun's body. In this position, referred to herein as "other-than-top-of-body position", the center of gravity is lowered and brought closer to the operator's body, thereby improving stability and reducing hand or wrist fatigue during extended use.

The paintball reservoir is connected to the breech via a paintball conduit, which function, as a transport pathway and queue for paintballs between the paintball reservoir and the breech. Paintballs are queued in the paintball conduit in preparation for transport into the breech. Paintballs deposited into the breech are ejected or fired out of the barrel (using for example compressed air or CO2) when the operator activates a trigger or switch.

In accordance with one or more embodiments of the invention, a paintball transport arrangement is provided. The paintball transport arrangement automatically moves paintballs from the paintball conduit into the breech when the breech is empty and open for receiving paintballs. The moving of one or more paintballs into the breech makes room for additional paintballs to be moved into the paintball conduit from the paintball reservoir. After a paintball is deposited into the breech and ready for firing and the paintballs are jammed against one another in the paintball conduit, the paintball transport arrangement automatically ceases moving paintballs into the breech and/or the paintball conduit and waits until the next time the breech is open to receive a paintball.

In accordance with one or more embodiments of the invention, the paintball moving force (i.e., the force employed to move the paintball from the paintball reservoir to the breech via the paintball conduit) is provided by an actuator working in cooperation with a transport mechanism. The actuator may be an electrical motor, a pneumatic actuator, springs, and/or levers, etc. The transport mechanism represents in one or inure embodiments a helical auger, a screw auger, a wheel, or a conveyor belt assembly, for example. The actuator is configured to provide paintball moving force to the transport mechanism whenever a paintball needs to be moved from the paintball conduit to the breech and/or from the paintball reservoir into the paintball conduit.

Figure 2:
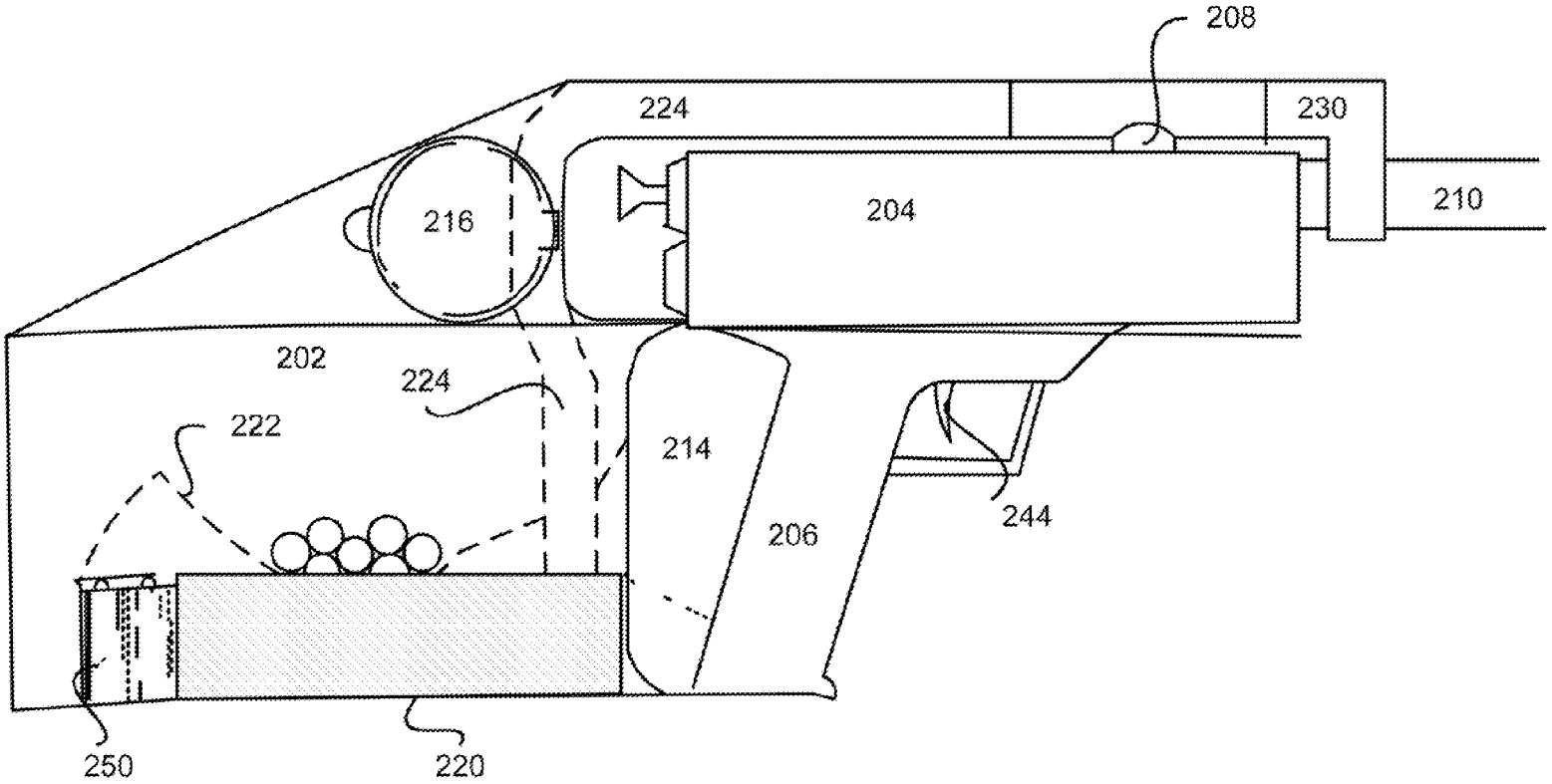
FIG. 2 shows, in accordance with an embodiment of the invention, an improved paintball gun.

The features and advantages of the present invention may be better understood with reference to the figures and discussions that follow. FIG. 2 shows, in accordance with an embodiment of the invention, a paintball gun 200, including a paintball reservoir 202, a body 204, a handle 206, a breech 208, and a barrel 210. Instead of being mounted on top of body 204, paintball reservoir 202 has been moved to a more proximal position relative to the operator's body as well as a lower center-of-gravity position. The repositioning of paintball reservoir 202 both reduces the target profile of the paintball gun as well as lowers its center of gravity and moves the center of gravity back to balance out the paintball gun when the operator grips handle 206. In the example of FIG. 2, paintball reservoir 202 is disposed proximal of (e.g., behind) handle 206 and closer to the operator body such that handle 206 is disposed between paintball reservoir 202 and trigger 244. However, paintball reservoir 202 or portion thereof may be disposed at any suitable location, including beside the gun body or under the handle, for example.

In the embodiment of FIG. 2, a thumb hole 214 is provided but this may be optional in some other embodiments. A refill cap 216 is shown. Refill cap 216 may be positioned on any suitable surface of paintball reservoir 202. The operator may utilize refill cap 216 to replenish paintball reservoir 202 with paintballs.

Paintball transport arrangement 220 is disposed under a chute or funnel 222, which serves to direct paintballs to fall into an opening of a paintball conduit, part of which is disposed within paintball transport arrangement 220. The construction and operation of paintball transport arrangement 220 will be discussed in details in FIG. 3 hereinbelow.

Paintballs are moved through paintball transport arrangement 220 and fed to breech 208 via a paintball conduit 224 that spans from chute 222 to breech 208. Within the paintball conduit 224, paintballs are queued and automatically fed into breech 208 when breech 208 is empty and open thr receiving paintballs. Once at least one paint ball is fed into breech 208 and the paintballs are jammed against one another in the paintball conduit, paintball transport arrangement 220 automatically ceases feeding paintballs along paintball conduit 224 to breech 208. An optional conduit brace 230 is also shown to help mechanically stabilize paintball conduit 224 by bracing paintball conduit 224 against barrel 210. When the operator pulls a trigger 244, the paintball in breech 208 is ejected or fired through and out of barrel 210. Thereafter, the breech 208 may open, ready to receive another paintball.

Figure 3:
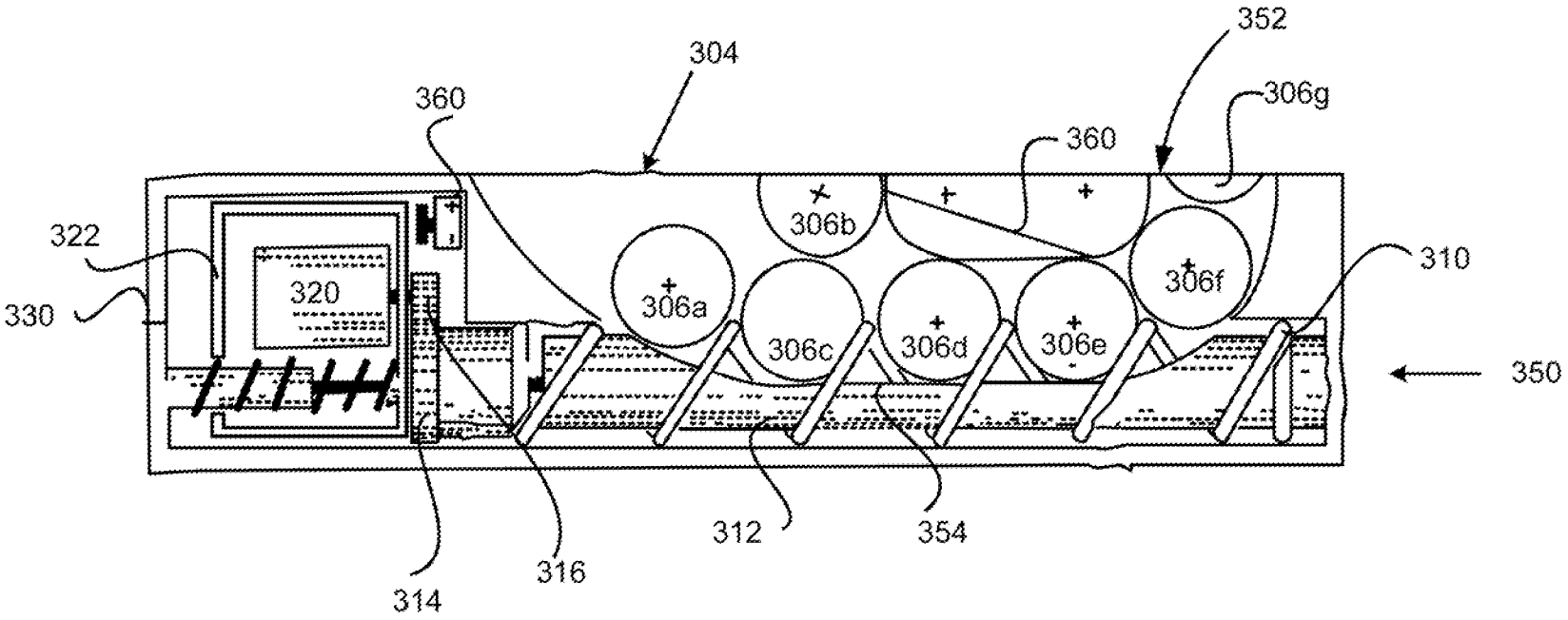
FIG. 3 shows, in accordance with an embodiment of the invention, an implementation of a paintball transport arrangement.

FIG. 3 shows, in accordance with an embodiment of the invention, an implementation of paintball transport arrangement 220 in greater detail. With reference to FIG. 3, conduit portion 352 represents a portion of the paintball conduit that spans from opening 304 to breech 208. A plurality of paintballs are shown queued up in conduit portion 352, of which paintballs 306*a*, 306*b*, 306*c*, 306*d*, 306*e*, 306*f*, and 306*g* are shown. A helical auger 310, which may be formed of plastic or metal, rotates around a core 312. Helical auger 310 is coupled to a gear 314, which in turn engages with a gear 316. Gear 316 is coupled to an electrical motor 320, which receives power from batteries (shown in FIG. 2 as reference number 250). Gears 314 and 316 are optional and are provided to reduce the rotational speed and/or increase torque output of motor electrical motor 320 if such speed reduction or torque increase is needed. Gears 314, 316, and motor 320 are coupled to a housing 322. Housing 322 is coupled to a spring 324, which permits a certain degree of lateral movement (left/right in the view of FIG. 2). Spring 324 is slightly compressed, thus exerting a force that biases housing 322 in the direction away from wall 330 toward helical auger 310. Together with motor 320, spring 324 provides actuation force to move paintballs along the paintball conduit toward the breech. A stud 332 is provided to retain spring 324 in place.

Helical auger 310 turns counter-clockwise when viewed along arrow 350 in order to feed paintballs along the paintball conduit toward the breech. Core 312 is shown with a concave portion 354 to accommodate paintballs queuing toward opening 352. When the paintball conduit is full, i.e., the breech is closed or not receiving paintballs, paintballs feeding cannot proceed since the paintballs are jammed against one another inside the paintball conduit at least between opening 352 and the breech entrance. The counter-clockwise rotation of helical auger 310 imparts a force against the stationary paintballs, such as paintball 306*e*, which pushes helical auger 310 to the left in the direction of arrow 350. Since helical auger 350 is coupled to gear 314 and housing 322, housing 322 is pushed to the left in the direction of arrow 350. When housing 322 is moved to the left, contact with a switch 360 is broken. Switch 360 controls motor 320. When contact with switch 360 is broken, current to motor 320 is interrupted, thus stopping the rotation of gears 316 and 314 as well as the rotation of helical auger 310. With helical auger 310 no longer rotating, helical auger 310 no longer feeds paintballs along the paintball conduit toward breech 208. In this state, battery power is conserved. In the pneumatic implementation, motor 320 and switch 360 may be implemented by pneumatic motor and switch, for example.

However, the leftward movement of housing 322 along the direction of arrow 350 further compresses spring 324. Spring 324 now exerts a force on housing 322 and the ridges of helical auger 310 to urge paintballs disposed in slots between the auger teeth/ridges in the direction toward opening 352 and breech 208. These paintball is in turn push on the balls already in the paintball conduit that are in the paintball transport arrangement 220 and breech 208. If the breech remains closed, the paintballs simply stayed queued up in the paintball conduit, with spring 324 exerting force (via helical auger 310) against the paintballs queued up in the paintball conduit. Note that this force is applied by spring 324, requiring no battery power from battery 250. If the breech opens and is available to accept paintballs, the biasing force exerted by spring 324 causes the queued up paintballs to move in the direction toward the breech, thereby deposition at least one paintball into breech 208 (see FIG. 2).

Since there are fewer paintballs in the paintball conduit in the position distal of opening 352 after a paintball partially or completely moves into the breech, the paintballs urged by spring 324 move to the right within the conduit, thereby allowing housing 322 to make contact again with switch 360. With contact made, current is restored to motor 320, and helical auger 310 again rotates to feed more paintballs toward breech 208 along the paintball conduit. If the breech remains closed, the paintballs will again be jammed against one another within the paintball conduit, thereby again causing helical auger 310 to push housing 322 to the left in the direction of arrow 350. This movement of housing 322 again breaks contact with switch 360, thereby cutting off current flow to motor 320, and the cycle continues in the manner discussed earlier. In this manner, the linearly translatable motion of housing 322 achieves the on/off control of the actuator (e.g., of motor 320).

FIG. 3 also shows a flexible bias mechanism 360, which may be implemented by, for example, a curved piece of plastic or metal. Flexible bias mechanism 360 helps directs paintballs into slots between the ridges or teeth of helical auger 310, thereby ensuring trouble-free feeding of paintballs along the paintball conduit.

As can be appreciated from the foregoing, current is only required in the brief moment when there is room in the paintball conduit to move additional paintballs toward the breech (e.g., after at least one paintball has been partially or fully fed into the breech). Once the breech is closed and paintballs are jammed against one another in the paintball conduit, current is no longer supplied to the motor (due to the opening of switch 360), thereby conserving battery power. While paintballs are jammed against one another in the conduit waiting for the breech to open, the biasing force that urges the paintballs in the paintball conduit toward the breech is supplied by spring 324, requiring no current from the batteries during the wait state.

Further, the feeding of paintballs into the breech is accomplished automatically when the breech opens (since spring 324 pushes paintballs queued in the paintball conduit toward the breech without suffering any switch-related or motor-related or control-related delay, and helical auger 310 further feeds paintballs toward the breech after switch 360 is closed). After at least one paintball has been fed into the breech and the breech closes, thus accepting no further paintballs, paintball feeding stops after the paintballs are jammed in the paintball conduit (due to the rotation of helical auger 310, which causes housing 322 to move to the left in the direction of arrow 350, thus breaking contact with switch 360). In this manner, paintball feeding starts/stops are accomplished automatically without operator intervention.

Figure 4:
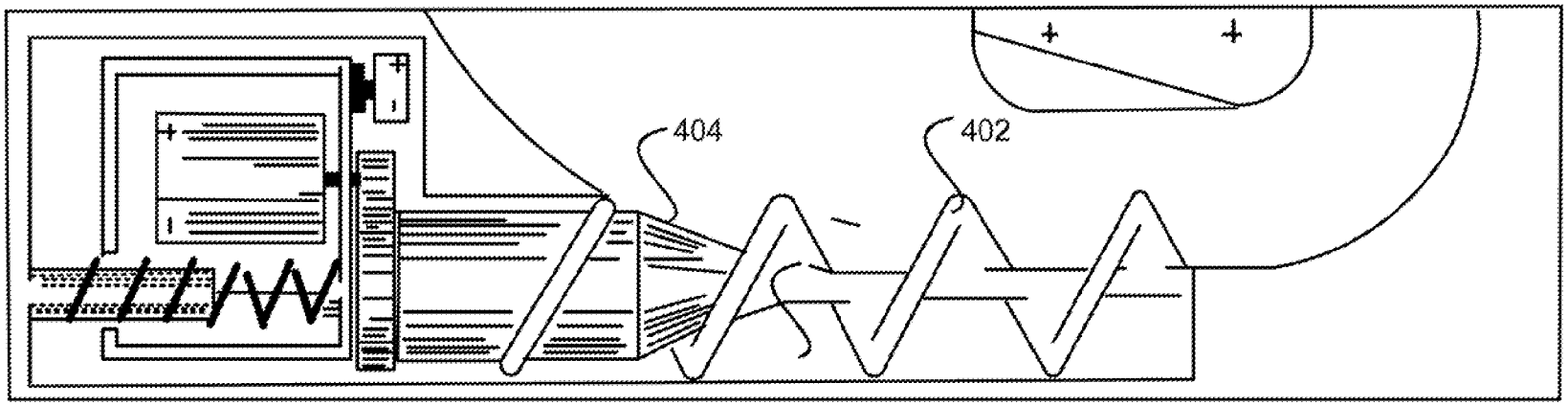
FIG. 4 shows, in accordance with an embodiment of the invention, a screw auger implementation.

Although FIG. 3 shows a helical auger, it is also possible to employ other mechanisms for feeding paintballs toward the breech along the paintball conduit. FIG. 4 shows, in accordance with an embodiment of the invention, a screw auger implementation in which screw auger 402 and core 404 rotate and translate left/right to accomplish the switch opening/closing as discussed in connection with FIG. 3 to automatically control the feeding of paintballs toward the breech.

Figure 5A:
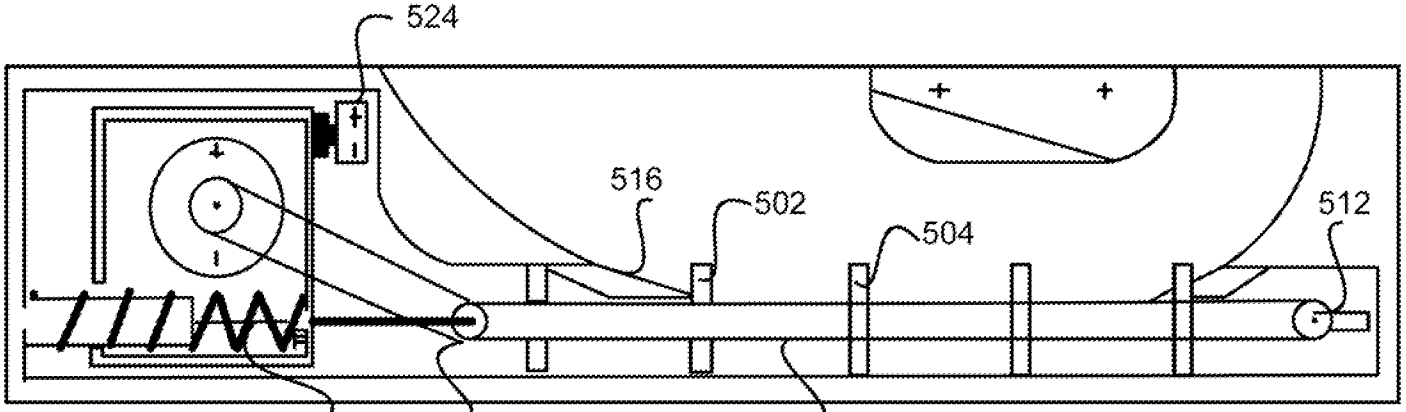
FIGS. 5A and 5B show, in accordance with an embodiment of the invention, a conveyor belt implementation.
Figure 5B:
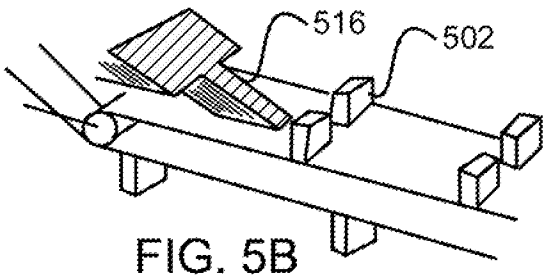

FIG. 5A shows, in accordance with an embodiment of the invention, a conveyor belt implementation in which paddles (such as paddles 502 and 504) are attached to a conveyor belt 506. Conveyor belt 506 rides on pulleys 512 and 510, one of which may be rotated by an appropriate electrical motor and/or gear combination. When conveyor belt 506 moves in the clockwise direction (as viewed into the page of FIG. 5A), the paddles move paintballs trapped between paddles toward the breech. Using spring 520 and switch 524, electrical contact make/break may be made to automatically start/stop paintball feeding in the manner analogous to that discussed earlier in connection with FIG. 3. FIG. 5B shows ramp 516 and paddle 502 in greater detail, in accordance with an embodiment of the present invention. In another embodiment, a paddle may be disposed in the middle of the conveyor belt and the ramp can be split to straddle the paddle as the paddle rotates on the conveyor belt.

Figure 6A:
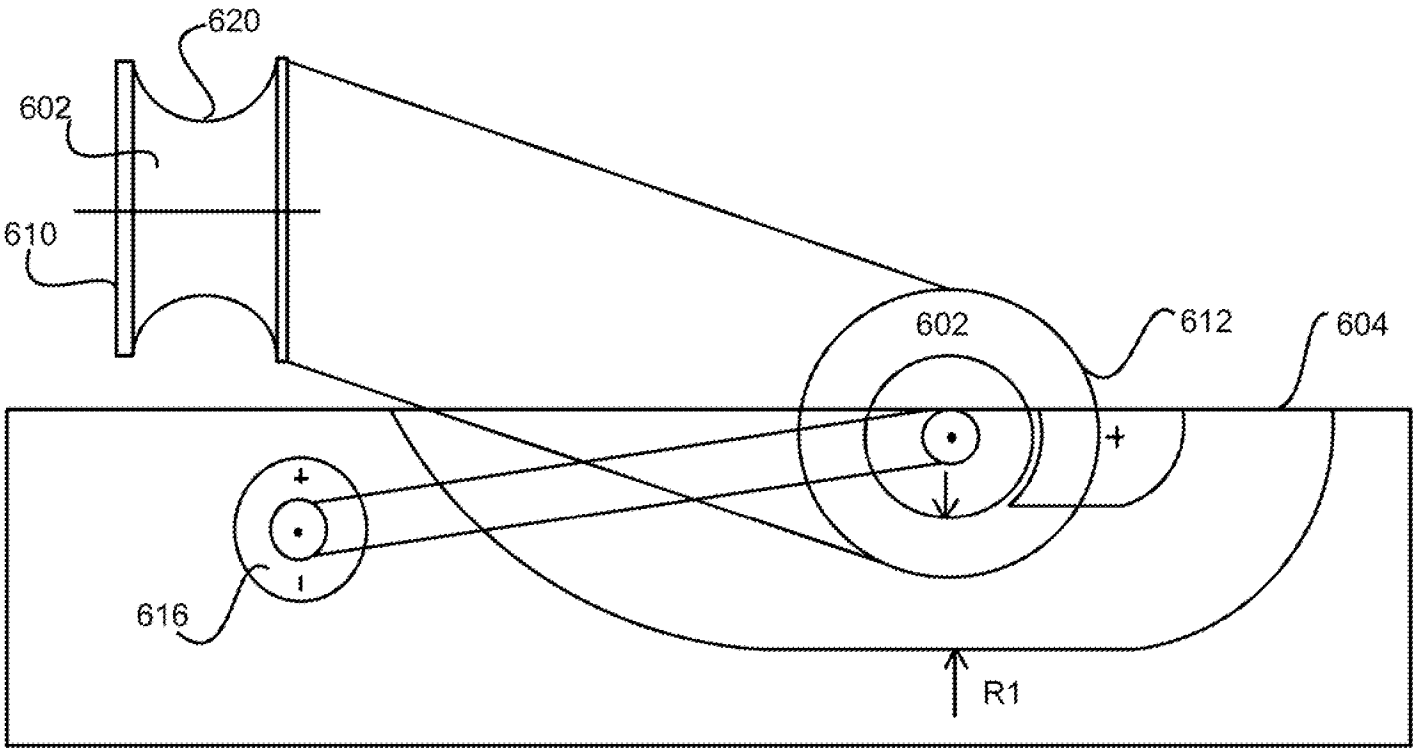
FIGS. 6A and 6B show, in accordance with an embodiment of the invention, a friction wheel implementation.

FIG. 6A shows, in accordance with an embodiment of the invention, a friction wheel implementation whereby a friction wheel 602 is employed to feed paintballs toward opening 604 and toward the breech. To facilitate discussion, friction wheel 602 is shown in its operational position (as indicated by reference arrow 612) and in a version that has been rotated 90 degrees to facilitate discussion (as indicated by reference arrow 610). In the example of FIG. 6A, friction wheel 602 has a groove (shown in the rotated version pointed to by arrow 620) to accommodate paintballs although the groove is not absolutely necessary. The paintball-contacting surface of friction wheel 602 is preferably a surface that has a sufficient coefficient of friction with the paintballs to help move the paintballs toward opening 604 and toward the breech when friction wheel 602 rotates in a counter-clockwise direction by motor 616 when viewed into the page of FIG. 6A).

Figure 6B:
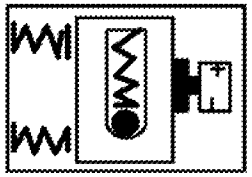

In the example of FIG. 6A, friction wheel 602 is permitted some degree of vertical movement while tending to be biased downward (using for example a spring) to allow for variation in the size of the paintball and some degree of horizontal movement to detect when paintballs are jammed against one another in the paintball conduit. The inner diameter of friction wheel 602 (indicated by reference arrow 620) is separated from the bottom of the paintball conduit by a distance R1 as shown wherein the height of the paintball conduit portion that is distal (relative to the operator when the gun is pointed away from the operator) to friction wheel 602 is slightly larger than R1. The constriction caused by the smaller R1, which is sized to be slightly smaller than the paintball diameter, helps friction wheel 602 pushes paintballs to the right toward opening 604 and the breech. Again, using an appropriate electrical contact making/breaking arrangement such as that shown in FIG. 6B (which operates analogously to that discussed in connection with FIG. 3), paintball feeding starts/stops can be made automatic. The adaptation and variations of the electrical contact making/breaking arrangement of FIG. 3 and FIG. 6B to operate with the friction wheel of FIG. 6A is within the ability of one of ordinary skill in the art.

Embodiments of the invention also contemplate variations, including variations in the actuator and sensors. For example, the spring component of the actuator mechanism may be mounted anywhere and may be implemented alternatively or additionally by levers, leaf springs, elastic bands, elastic springs, torsion rods, etc. The switch employed to achieve on/off control may be mounted at any suitable location and implemented alternatively or additionally by lever switch infrared sensor that detect auger movement or paintball movement, vibration sensor or sound sensor that senses when the gun is fired, etc.

Figure 7A:
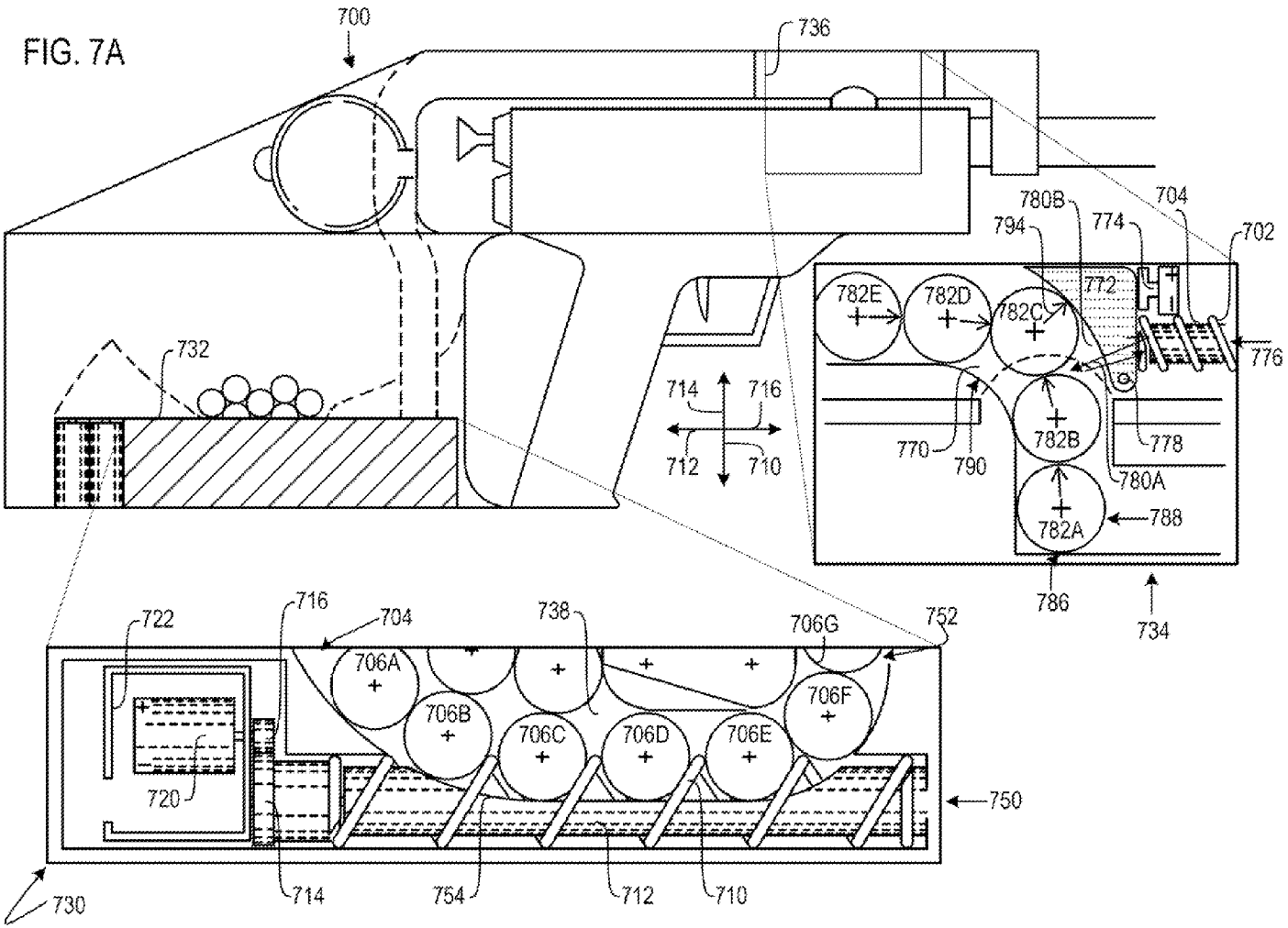
FIG. 7A shows, in accordance with an embodiment of the invention, a simplified view of another implementation of the paintball gun, including a current control mechanism.

FIG. 7A shows, in accordance with an embodiment of the invention, a simplified view of another implementation of paintball gun 700. The implementation of FIG. 7A differs from the implementation of FIG. 3 in that the housing 722 in FIG. 7A does not translate laterally to activate/deactivate the motor switch. Instead, a paintball-activated feed mechanism is employed to activate/deactivate the motor switch as will be discussed later herein. In FIG. 7A, expanded drawing portion 730 represents a more detailed drawing of internal mechanisms of paintball transport arrangement 732. Expanded drawing portion 734 represents a more detailed drawing of internal mechanisms of current control subsystem 736.

With reference to FIG. 7A, conduit portion 738 represents a portion of the paintball conduit that spans from opening 704 to the paintball gun breech. A plurality of paintballs are shown queued up in the conduit portion between opening 704 and opening 752, of which paintballs 706A, 706B, 706C, 706D, 706E, 706F, and 706G are shown. A helical auger 710, which may be formed of plastic or metal, rotates around a core 712. Helical auger 710 is coupled to a gear 714, which in turn engages with a gear 716. Gear 716 is coupled to an electrical motor 720, which receives power from batteries (shown in FIG. 2 as reference number 250). Gears 714 and 716 are optional and are provided to reduce the rotational speed and/or increase torque output of motor electrical motor 720 if such speed reduction or torque increase is needed. Gears 714, 716, and motor 720 are coupled to a housing 722.

In contrast to housing 322 of FIG. 3, housing 722 does not need to translate laterally to activate/deactivate the motor switch. In the implementation of FIG. 7A, housing 722 may be stationary with respect to the paint gun.

Helical auger 710 turns counter-clockwise when viewed, along, arrow 750 in order to feed paintballs along the paintball conduit toward opening 752 and the breech. Core 712 is shown with a concave portion 754 to accommodate paintballs queuing toward opening 752. When the paintball conduit is full, i.e., the breech is closed or not receiving paintball, paintballs feeding cannot proceed since the paintballs are jammed against one another inside the paintball conduit at least between opening 752 and the breech entrance.

FIG. 7A also shows an expanded drawing portion 734 of paintball gun 700 that includes the four major components of the paintball-activated feed mechanism: a non-linear conduit portion 770, a switch activator 772, a switch 774, and activator bias mechanism 776. When paintball 782A is in the breech and ready for firing, the rotation of helical auger 710 around core 712 threes paintballs 782A-782E, as well as other paintballs along the feed path (such as paintballs 706A-706G) against one another. With paintball 782A resting against the floor 786 of breech 788, paintball 782A is immobile. In this case, paintball 782D and paintball 782B exert biasing forces against paintball 782C. These biasing forces are provided by helical auger 710 which forces the paintballs in the feed path against one another.

The curvature 790 of non-linear conduit portion 770 is configured such that the biasing forces exerted by paint ball 782D and paintball 762B on paintball 782C tend to force paintball 782C in the direction of vector 794 toward switch activator 772.

Switch activator 772 rotates around pivot 778 (which may be implemented by a pin that is oriented in the direction into the page of the drawing of FIG. 7A, for example). Switch activator 772 is biased at all times by activator bias mechanism 776 (implemented by a spring 702 and rod 704 in the example of FIG. 7A) in the direction of arrow 780B. When paintball 782C is pushed by paintballs 782B and 782D in the direction of vector 794, the force exerted by paintball 782C in the direction of vector 794 overcomes the biasing force supplied by activator bias mechanism 776. Consequently, switch activator 772 is physically forced by paintball 782C and rotates in the direction of arrow 780A around pivot 778. Switch activator 772 is pushed by paintball 782C into a first position that makes physical contact with and presses against switch 774. In this first position where switch activator 772 makes physical contact with switch 774, switch activator 772 is said to be in its first state. If a switch that does not require physical contact (such as a switch activated by light, current, magnetic field, etc.) is employed, the switch state may be made dependent on the position of the switch activator, for example.

Returning to the example of FIG. 7A, when switch 774 is pressed, switch 774 enters a first switch state. In the example of FIG. 7A, the first switch state results in switch 774 cutting off or not permitting the current flow to the motor, thus causing helical auger 710 to stop rotating. Further, when the current flow to the motor is cut off, no energy is expended while waiting for paintball 782A to be fired.

After paintball 782A is fired, paintball 782A (which is removed from breech 788) no longer provides a biasing force against paintball 782B. In an alternate embodiment where paintball 782A represents the paintball that is waiting to be dropped into the breech, paintball 782A would drop into the breech and no longer exerts a biasing force against paintball 782C as well.

In either case, paintball 782B no longer provides a biasing force against paintball 782C. Without the biasing force exerted by paintball 782B, paintball 782C is no longer biased in the direction of vector 794 by paintballs 782B and 782D. Since switch activator 772 continues to be biased by activator bias mechanism 776 in the direction of arrow 780B, switch activator 772 rotates away from switch 774 to occupy a second position in the absence of a biasing force provided by paintball 782C.

Figure 8:
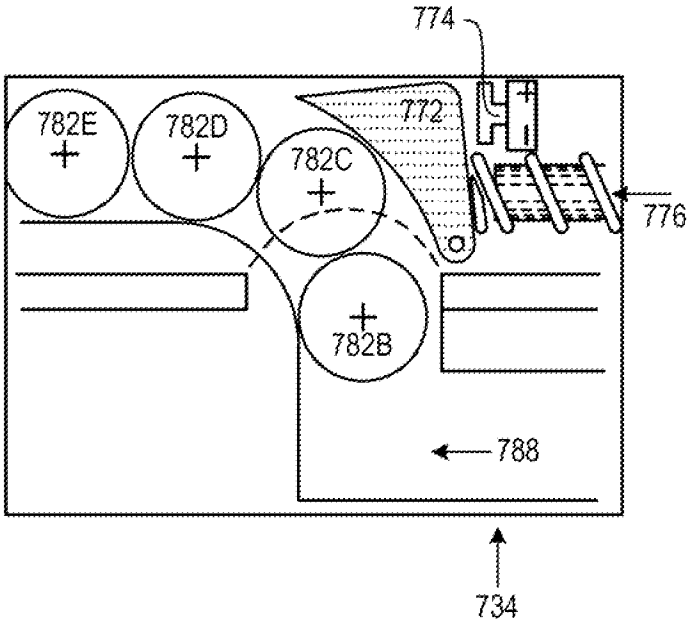
FIG. 8 shows, in accordance with an embodiment of the invention, the current control mechanism of FIG. 7A when the switch activator is in the second state.

When switch activator 772 rotates away from switch 774 to occupy a second position switch 774 (which may be spring-loaded) is no longer pressed. Switch activator 772 is said to be in a second state in this situation, which is shown in FIG. 8, and switch 774 is said to be in its second switch state. Current flows again through switch 774 in this second switch state, which supplies or permits current (either directly or via some solenoid arrangement) to flow to the motor that turns helical auger 710. The turning of helical auger 710 feeds paintballs from the paintball reservoir toward breech 788 until another paintball jams up against floor 786 of breech 788, causing the whole sequence of paintball jamming up and switch activator 772 being pushed in the direction of arrow 780A again to press against switch 774 and cut off current to the motor. The current to the motor then stays cut off, advantageously enabling the paintball gun to consume no energy until the paintball in the breech is fired again.

Although switch 774 is shown disposed above activator bias mechanism 776, it is possible to dispose switch 774 below activator bias mechanism 776 (by swapping their respective locations) if desired.

Figure 7B:
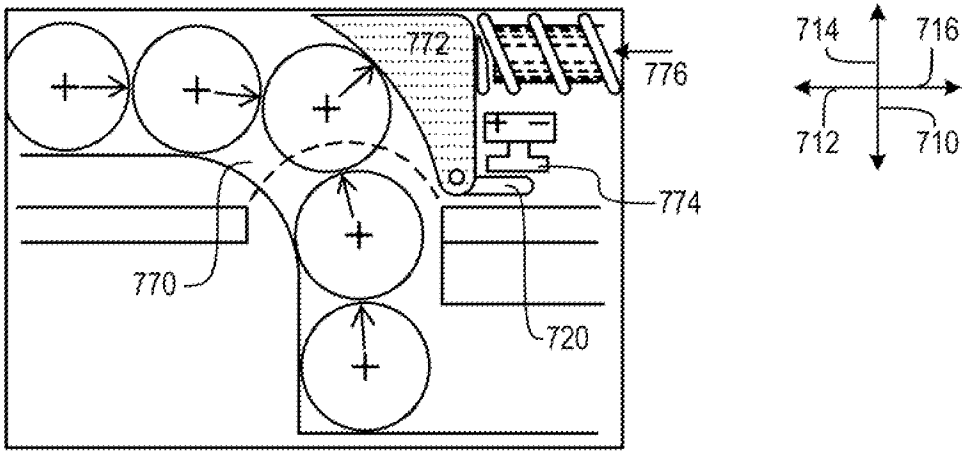
FIG. 7B shows, in accordance with an embodiment of the invention, another implementation of the current control mechanism.

Further, although switch 774 is shown facing in the direction of arrow 712 toward switch activator 772 in FIG. 7B, switch 774 may be oriented downward in the direction of arrow 710 via an appropriate angled extension. FIG. 7B shows the situation where switch 774 is disposed below activator bias mechanism 776 and oriented downward in the direction of arrow 710. Angled extension is shown by reference number 720 in FIG. 7B.

Alternatively, although switch 774 is shown disposed above activator bias mechanism 776 and facing in the direction of arrow 712 toward switch activator 772 in FIG. 7A, switch 774 may be oriented disposed above activator bias mechanism 776 and faces upward in the direction of arrow 714 via another appropriate angled extension if desired.

Although activator bias mechanism 776 is shown implemented by spring 702 and rod 704, any other type of biasing arrangement, including for example a spring that pulls (instead of pushes) switch activator 772 in the direction of arrow 780B, may be employed. Alternatively, a compressive material (such as a rubber part) may be employed in place spring 702/rod 704. Alternatively, a cam arrangement may be employed to cause switch activator 772 to be biased in the direction of arrow 78013. Alternatively, such biasing may be performed by torsion spring, leaf spring, etc. It should be appreciated that these and other biasing arrangements for biasing switch activator 772 in the direction of arrow 780B, may be employed without departing, from the scope and spirit of the invention.

Further, although switch activator 772 is shown rotating around pivot 778 that is located at the bottom of switch activator 772, pivot 778 may be disposed at the top of (from the viewpoint of FIG. 7A) switch activator 772 if desired. Alternatively or additionally, although switch activator 772 is urged by paintball 782C of FIG. 7A to rotate around a pivot, a switch activator may he urged by a bias mechanism and paintball to translate linearly in the directions of arrows 712 and 716 respectively (along appropriately designed rails or guides for example) to accomplish the function of activating/deactivating a switch.

Generally speaking, the switch activator may be implemented in any manner as long as it occupies two positions (a first position when pressed by a paintball and a second position when not pressed by a paintball) and has thus two states. These two positions/states of the switch activator cause the switch to be in two switch states (one that allows current to flow to the motor and one that does not allow current to flow to the motor). Within these design parameters and in view of the teachings of this disclosure, one skilled in the an should appreciate that there are multiple possible ways to design and position the switch activator and the switch to achieve the result/function/arrangement discussed herein.

It should be appreciated that although current control subsystem 736 is implemented toward the breech of the paintball gun of FIG. 7, such current control subsystem may be implemented anywhere downstream of paintball transport arrangement 732 that has a non-linear conduit portion.

Although physical contact is described in the example of FIG. 7A as the method for activating the switch, a switch that may be tripped by non-physical contact (e.g., magnetic, light, current, etc.) may also be employed (in which case, physical contact by the switch activator against the switch is not necessary). As long as the movement and/or position of the switch activator can be detected by the switch (or a sensor in communication therewith) to discriminate between the first state in which the switch activator is pushed or pressed by a paintball and the second state in which the switch activator is not pushed or pressed by a paintball, it is possible to implement a paintball-activated feed arrangement given the teachings of this disclosure.

As can be appreciated from the foregoing, current is only required in the brief moment when there is room in the paintball conduit to move an additional paintball into the breech. Once the breech is closed or when paintballs are jammed against one another in the paintball conduit, current is no longer supplied to the motor (due to the opening of switch 774), thereby conserving battery power. While paintballs are jammed against one another in the conduit waiting for the paintball to the breech to be fired and/or for the breech to open to receive another paintball, switch 774 is open to cut off the current, requiring no current, from the batteries during the wait state.

Although the implementations of FIGS. 7A-7B and FIG. 8 employ a switch that cuts off the current to the motor when depressed, it is also possible to employ a switch that supplies current to the switch when depressed. By appropriately positioning the switch with respect to switch activator 772 (either with or without a linkage arrangement as would be obvious to one skilled in the art given this disclosure), it is possible to use such a switch that supplies current when the switch is depressed to perform the current control function discussed herein.

Figure 9:
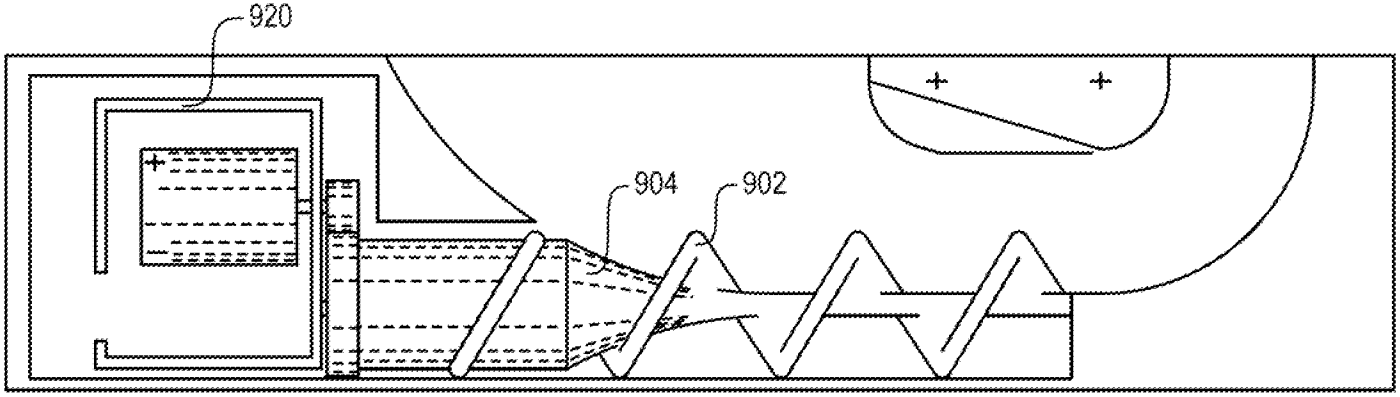
FIG. 9 shows, in accordance with an embodiment of the invention, a screw auger implementation.

Although FIGS. 7A-7B shows a helical auger for example, it is also possible to employ other mechanisms for feeding paintballs toward the breech along the paintball conduit. FIG. 9 shows, in accordance with an embodiment of the invention, a screw auger implementation in which screw auger 902 and core 904 rotate to feed paintballs toward the breech. The implementation of FIG. 9 differs from the implementation of FIG. 4 in that housing 920 does not need to translate as in the case of the housing of FIG. 4 to provide the function of activating/deactivating a switch as this function would be provided by the paintball-activated feed mechanism as discussed above.

Figure 10A:
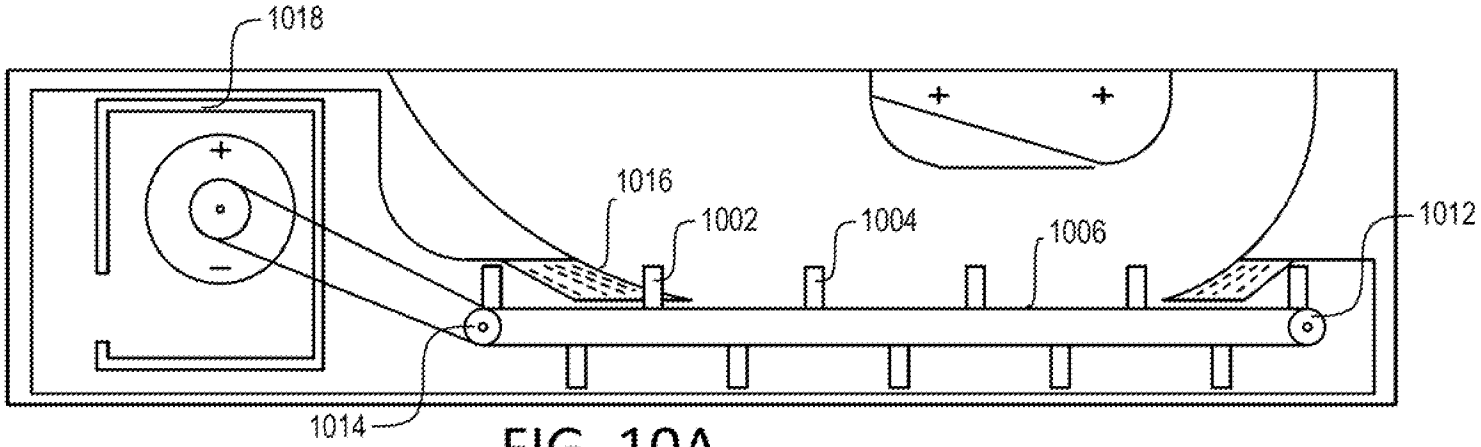
FIGS. 10A and 10B show, in accordance with embodiments of the invention, a conveyor belt implementation.
Figure 10B:
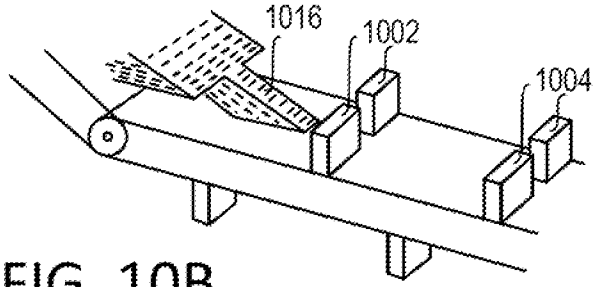

FIG. 10A shows, in accordance with an embodiment of the invention, a conveyor belt implementation in which paddles (such as paddles 1002 and 1004) are attached to a conveyor belt 1006. Conveyor belt 1006 rides on pulleys 1012 and 1014, one of which may he rotated by an appropriate electrical motor and/or gear/belt combination. When conveyor belt 1006 moves in the clockwise direction (as viewed into the page of FIG. 10A), paintballs are fed down ramp 1016 and the paddles move paintballs trapped between paddles toward the breech. The paddles 1002/1004 and ramp 1016 of FIG. 10A are shown in greater detail in FIG. 10B. The implementation of FIGS. 10A and 10B is analogous to the implementations of FIGS. 5A and 5B except that in the implementation of FIG. 10A, housing 1018 of FIG. 10A does not need to translate as in the case of the housing of FIG. 5A to provide the function of activating/deactivating a switch as this function would be provided by the paintball-activated feed mechanism as discussed above.

Figure 11:
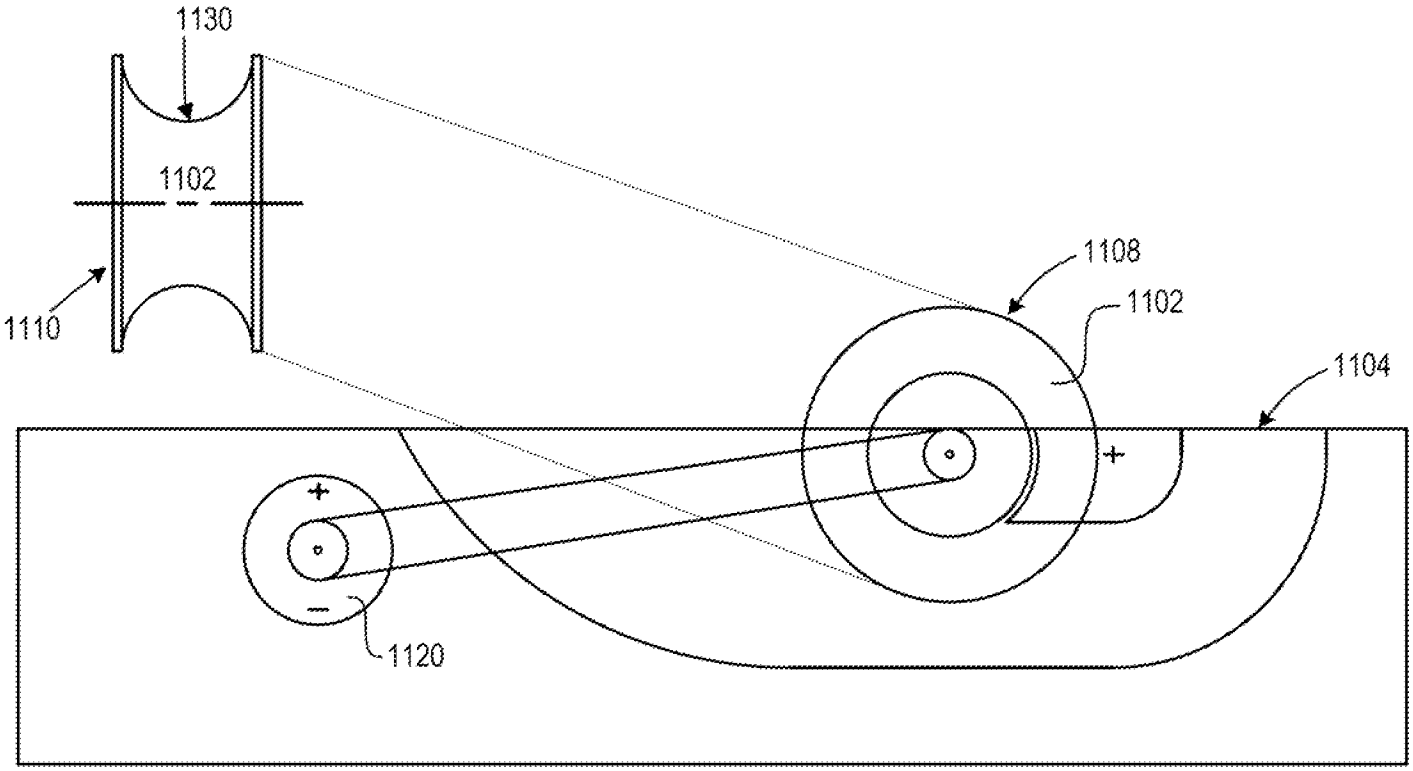
FIG. 11 shows, in accordance with an embodiment of the invention, a friction wheel implementation.

FIG. 11 shows, in accordance with an embodiment of the invention, a friction wheel implementation whereby a friction wheel 1102 is employed to feed paintballs toward opening 1104 and toward the breech. To facilitate discussion, friction wheel 1102 is shown in its operational position (as indicated by reference arrow 1108) and in a version that has been rotated 90 degrees to facilitate discussion (as indicated by reference arrow 1110). In the example of FIG. 11, friction wheel 1102 has a groove 1130 (shown in the rotated version pointed to by arrow 1110) to accommodate paintballs although the groove is not absolutely necessary. The paintball-contacting surface of friction wheel 1102 is preferably a surface that has a sufficient coefficient of friction with the paintballs to help move the paintballs toward opening 1104 and toward the breech when friction wheel 1102 rotates in a counter-clockwise direction (when viewed into the page of FIG. 11) by motor 120. The implementation of FIG. 11 is analogous to the implementation of FIG. 6A except that in the implementation of FIG. 11, friction wheel 1102 does not need to move to provide the function of activating/deactivating a switch as this function would be provided by the paintball-activated feed mechanism as discussed above.

While this invention has been described in terms of several preferred embodiments, there are alterations, permutations, and equivalents, which fall within the scope of this invention. Although various examples are provided herein, it is intended that these examples be illustrative and not limiting with respect to the invention. Also, the title and summary are provided herein for convenience and should not be used to construe the scope of the claims herein. Further, the abstract is written in a highly abbreviated form and is provided herein for convenience and thus should not be employed to construe or limit the overall invention, which is expressed in the claims. If the term "set" is employed herein, such term is intended to have its commonly understood mathematical meaning to cover zero, one, or more than one member. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

Having disclosed exemplary embodiments and the best mode, modifications and variations may be made to the disclosed embodiments while remaining within the subject and spirit of the invention as defined by the following claims.

What is claimed is:

1. A paintball ejecting apparatus having, a body, a breech, and a barrel for ejecting paintballs through and out of said barrel, comprising:

a paintball reservoir disposed in an other-than-top-of-body position;

a paintball conduit coupling said paintball reservoir to said breech for facilitating transport of paintballs from said paintball reservoir to said breech, said paintball conduit including at least one non-linear conduit portion;

a paintball transport arrangement having a motor that provides paintball-moving force on at least some of said paintballs in said paintball reservoir, said paintball transport arrangement automatically moves at least a first paintball from said paintball conduit into said breech if said breech is empty and open for receiving said at least first paintball, said paintball transport arrangement automatically ceasing moving another paintball into said breech after said at least first paintball is disposed in said breech; and a paintball-activated feed mechanism including at least a switch activator and a switch, said switch activator having at least a first state and a second state, said switch activator in said first state is urged by a second paintball in said paintball conduit to occupy a first position that results in a first switch state by said switch, whereby said switch does not permit current to flow to said motor when said switch is in said first switch state, said switch activator in said second state is not urged by any paintball in said paintball conduit when said breech is empty and open for receiving another paintball from said paintball conduit, said switch activator occupying a second position that results in a second switch state by said switch, whereby said switch permits said current to flow to said motor when said switch is in said second switch state and whereby said switch activator physically contacts said switch when said switch activator is in said first state to cause said switch to enter into said first switch state when said switch is physically contacted by said switch activator.

2. The paintball ejecting apparatus of claim 1 wherein said paintball transport arrangement includes an auger operatively coupled to an actuator for moving said paintballs from said paintball reservoir into said conduit.

3. The paintball ejecting apparatus of claim 2 wherein said auger represents a helical auger that rotates around a non-rotating core.

4. The paintball ejecting apparatus of claim 2 wherein said auger represents a screw auger.

5. The paintball ejecting apparatus of claim 1 wherein said paintball transport arrangement includes a conveyor belt operatively coupled to an actuator for moving said paintballs from said paintball conduit toward said breech.

6. The paintball ejecting apparatus of claim 1 wherein said paintball transport arrangement includes a friction wheel operatively coupled to an actuator for moving said paintballs from said paintball conduit toward said breech.

7. The paintball ejecting apparatus of claim 1 wherein said paintball transport arrangement includes a flexible guide for urging paintballs into slots of said paintball transport arrangement.

8. The paintball ejecting apparatus of claim 1 wherein said switch activator is rotatable around a pivot to occupy said first position and said second position respectively.

9. The paintball ejecting apparatus of claim 1 wherein said switch activator is linearly translatable to occupy said first position and said second position respectively.

10. A paintball ejecting apparatus having a body, a breech, and a barrel for ejecting paintballs through and out of said barrel, comprising:

a paintball reservoir disposed in an other-than-top-of-body position;

a paintball conduit coupling said paintball reservoir to said breech for facilitating transport of paintballs from said paintball reservoir to said breech, said paintball conduit including at least one non-linear conduit portion;

a paintball transport arrangement having a motor that provides paintball-moving force on at least some of said paintballs in said paintball reservoir, said paintball transport arrangement automatically moves at least as first paintball from said paintball conduit into said breech if said breech is empty and open for receiving said at least first paintball, said paintball transport arrangement automatically ceasing moving another paintball into said breech after said at least first paintball is disposed in said breech; and a paintball-activated feed mechanism including at least a switch activator and a switch, said switch activator having at least a first state and a second state, said switch activator in said first state is urged by a second paintball in said paintball conduit to occupy a first position that results in a first switch state by said switch, whereby said switch does not permit current to flow to said motor when said switch is in said first switch state, said switch activator in said second state is not urged by any paintball in said paintball conduit when said breech is empty and open for receiving another paintball from said paintball conduit, said switch activator occupying a second position that results in a second switch state by said switch, whereby said switch permits said current to flow to said motor when said switch is in said second switch state;

wherein said switch activator is disposed at said non-linear conduit portion.

11. A paintball ejecting apparatus having at least a breech for ejecting paintballs from said breech, comprising:

a paintball reservoir disposed in an other-than-top-of-body position;

a paintball conduit coupling said paintball reservoir to said breech for facilitating transport of paintballs from said paintball reservoir to said breech, said paintball conduit including at least one non-linear conduit portion;

a motor supplying paint-ball moving force to move said paintballs through said paintball conduit; and a current control mechanism to control current flow to said motor, said current control mechanism including at least a switch activator disposed at said non-linear conduit portion and a switch, said switch activator having at least a first state and a second state, said switch activator in said first state is physically forced by a paintball in said paintball conduit to occupy a first position that results in said switch being in a first switch state that does not permit a current to flow to said motor, said switch activator in said second state is not physically forced by any paintball in said paintball conduit, said switch activator in said second state occupies a second position that results in said switch permitting said current to flow to said motor, whereby said switch activator physically contacts said switch when said switch activator is in said first state to cause said switch to enter into said first switch state when said switch is physically contacted by said switch activator.

12. The paintball ejecting apparatus of claim 11 further includes an auger operatively coupled to said motor for moving said paintballs from said paintball reservoir into said conduit.

13. The paintball ejecting apparatus of claim 12 wherein said auger represents a helical auger that rotates around a non-rotating core.

14. The paintball ejecting apparatus of claim 12 wherein said auger represents a screw auger.

15. The paintball ejecting apparatus of claim 11 further including a conveyor belt operatively coupled to said motor, said conveyor belts moving said paintballs using a plurality of paddles.

16. The paintball ejecting apparatus of claim 11 further comprising a friction wheel operatively coupled to said motor for moving said paintballs from said paintball conduit toward said breech.

17. The paintball ejecting apparatus of claim 11 wherein said switch activator is linearly translatable to occupy said first position and said second position respectively.

18. A paintball ejecting apparatus having at least a breech for ejecting paintballs from said breech, comprising:

a paintball reservoir disposed in an other-than-top-of-body position;

a paintball conduit coupling said paintball reservoir to said breech for facilitating transport of paintballs from said paintball reservoir to said breech, said paintball conduit including at least one non-linear conduit portion;

a motor supplying paint-ball moving force to move said paintballs through said paintball conduit; and a current control mechanism to control current flow to said motor, said current control mechanism including at least a switch activator disposed at said non-linear conduit portion and a switch, said switch activator having at least a first state and a second state, said switch activator in said first state is physically forced by a paintball in said paintball conduit to occupy a first position that results in said switch being in a first switch state that does not permit a current to flow to said motor, said switch activator in said second state is not physically forced by any paintball in said paintball conduit, said switch activator in said second state occupies a second position that results in said switch permitting said current to flow to said motor;

wherein said switch activator is rotatable around a pivot to occupy said first position and said second position respectively.

* * * * *